US012128280B2

(12) United States Patent
Burgess

(10) Patent No.: US 12,128,280 B2
(45) Date of Patent: Oct. 29, 2024

(54) ANTI-LEG DROOP SYSTEM FOR A GOLF BAG

(71) Applicant: Acushnet Company, Fairhaven, MA (US)

(72) Inventor: Ian Burgess, Tiverton, RI (US)

(73) Assignee: Acushnet Company, Fairhaven, MA (US)

( * ) Notice: Subject to any disclaimer, the term of this patent is extended or adjusted under 35 U.S.C. 154(b) by 326 days.

(21) Appl. No.: 17/666,822

(22) Filed: Feb. 8, 2022

(65) Prior Publication Data

US 2023/0249041 A1 Aug. 10, 2023

(51) Int. Cl.
*A63B 55/57* (2015.01)
*A63B 55/53* (2015.01)

(52) U.S. Cl.
CPC ..... *A63B 55/57* (2015.10); *A63B 55/53* (2015.10)

(58) Field of Classification Search
CPC ..... A63B 55/57; A63B 5/53
USPC ..... 206/315.7
See application file for complete search history.

(56) References Cited

U.S. PATENT DOCUMENTS

2021/0146208 A1* 5/2021 Burgess ..... A63B 55/57

* cited by examiner

*Primary Examiner* — Don M Anderson
*Assistant Examiner* — Jessica Kavini Tamil

(57) ABSTRACT

An improved leg-deployment system for a golf bag that helps prevent leg droop when the legs are in the retracted state. In an aspect, the technology relates to a golf bag that includes a bag body; a base coupled to the bag body; a top cuff coupled to the bag body; and a leg-deployment system coupled to the top cuff. The leg-deployment system may include a leg receptacle protruding away from an exterior surface of the top cuff; a spring insert inserted into the receptacle, the spring insert including a cantilevered spring segment having a fixed end and a free end; and a leg assembly including a cam nose, wherein the cam nose contacts the cantilevered spring segment when the leg assembly is in a retracted state, and the cantilevered spring segment applies a force to the cam nose to maintain the leg assembly in the retracted state.

20 Claims, 8 Drawing Sheets

ANTI-LEG DROOP SYSTEM FOR A GOLF BAG

BACKGROUND

During the game of golf, a golfer may carry his or her golf bag. Many golf bags include expandable legs. The legs are normally in a retracted or collapsed position when the golfer carries the golf bag. When the golfer sets the golf bag on the ground, the legs expand and provide a base for the bag to the stand on the ground without the body of the bag having to be set on the ground.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe an improved leg-deployment system for a golf bag that helps prevent leg droop when the legs are in the retracted state. In an aspect, the technology relates to a golf bag that includes a bag body; a base coupled to the bag body; a top cuff coupled to the bag body; and a leg-deployment system coupled to the top cuff. The leg-deployment system includes a leg receptacle protruding away from an exterior surface of the top cuff; a spring insert inserted into the receptacle, the spring insert including a cantilevered spring segment having a fixed end and a free end; and a leg assembly including a cam nose, wherein the cam nose contacts the cantilevered spring segment when the leg assembly is in a retracted state, and the cantilevered spring segment applies a force to the cam nose to maintain the leg assembly in the retracted state.

In an example, the cantilevered spring segment includes a recessed portion between the fixed end and the free end, and the cam nose is positioned in contact with the recessed portion when the leg assembly is in the retracted state. In another example, the cam nose is not in contact with the recessed portion when the leg assembly is in an expanded state. In yet another example, the leg-deployment system further includes a pin having a shaft that extends through the leg receptacle, the spring insert, and the leg assembly, wherein the leg assembly is configured to rotate around the shaft. In a further example, rotation of the leg assembly around the shaft during a transition from the retracted state to an expanded state causes the cam nose to rotate towards the exterior surface of the top cuff. In still another example, when in the retracted state, the cam nose protrudes upward and away from the exterior surface of the top cuff relative to the shaft.

In another example, the spring insert is made of a metallic material and the leg receptacle is made of a molded plastic material. In still another example, the leg receptacle includes an outer side wall that has a first depth and inner side wall that has a second depth that is different from the first depth. In yet another example, the leg receptacle includes an outer side wall that has a first depth and inner side wall that has a second depth that is substantially the same as the first depth.

In another aspect, the technology relates to a golf bag that includes a bag body; a base coupled to the bag body; a top cuff coupled to the bag body; and a leg-deployment system coupled to the top cuff. The leg-deployment system includes a receptacle protruding away from an exterior surface of the top cuff, the receptacle including a top wall, an outer side wall, and an inner side wall that at least partially define a cavity; a spring insert inserted into the cavity, the spring insert including a cantilevered spring segment having a fixed end, a free end, and a recessed portion positioned between the fixed end and the free end; and a leg assembly including a cam nose, wherein the cam nose contacts the recessed portion when the leg assembly is in a retracted state, and the cantilevered spring segment applies a force to the cam nose to maintain the leg assembly in the retracted state.

In an example, the cam nose is not in contact with the recessed portion when the leg assembly is in an expanded state. In another example, the leg-deployment system further includes a pin having a shaft that extends through the receptacle, the spring insert, and the leg assembly, wherein the leg assembly is configured to rotate around the shaft. In still another example, rotation of the leg assembly around the shaft moving from the retracted state to an expanded state causes the cam nose to rotate towards the exterior surface of the top cuff. In a further example, when in the retracted state, the cam nose protrudes upward and away from the exterior surface of the top cuff relative to the shaft. In yet another example, the receptacle includes an outer side wall that has a first depth and inner side wall that has a second depth that is different from the first depth.

In another aspect, the technology relates to a golf bag that includes a bag body; a base coupled to the bag body; a top cuff coupled to the bag body; a leg receptacle protruding away from an exterior surface of the top cuff, the leg receptacle including a top wall, an outer side wall, and an inner side wall that at least partially define a cavity, wherein the top wall defines a cantilevered spring segment that protrudes at least partially into the cavity; and a leg assembly including a cam nose inserted into the cavity, wherein the cam nose contacts the cantilevered spring segment when the leg assembly is in a retracted state, and the cantilevered spring segment applies a force to the cam nose to maintain the leg assembly in the retracted state.

In an example, the cantilevered spring segment includes a fixed end, a free end, and a recessed portion between the fixed end and the free end. In yet another example, when the leg assembly is in the retracted state, the cam nose contacts the recessed portion. In still another example, the cam nose is not in contact with the recessed portion when the leg assembly is in an expanded state. In a further example, the cam nose has a cam nose angle (0) between 30-70 degrees.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

As discussed above, carry golf bags often include expandable legs that expand when the golfer sets the golf bag on the ground. When the golfer then picks the bag up, the legs retract so that the legs should not interfere with the golfer while walking. All too often, however, the legs tend to droop or drift when the bag is being carried and the legs are in the collapsed position. This droop of the legs causes the legs of the golf bag to fall away from the bag body and potentially interfere with the golfer's gait while carrying the golf bag.

The present technology addresses the leg droop problem and keeps the legs of the golf bag surely tucked up against the body of the golf bag such that the legs do not interfere with the golfer while the golf bag is being carried. For instance, the present technology uses a spring in the leg-deployment mechanism or system that assists with keeping the legs from drooping downwardly. As one example, an overcam pressure type system is used. A spring is used to apply pressure to an upper portion of a leg assembly above a pivot point to provide a force that helps hold the leg in place in the collapsed position. The spring may be a flat or cantilevered spring that is integrated into an insert or cartridge that is inserted into a receptacle protruding from a top cuff of the golf bag. The spring inserts may be made asymmetric or symmetric. In an asymmetric example, different spring inserts are used for the left and the right leg. In contrast, in the symmetric example, the same spring insert may be used for the left and the right leg. In some examples, a spring may be formed directly into a top of the receptacle such that the insert or cartridge is not necessary.

Figure 1:
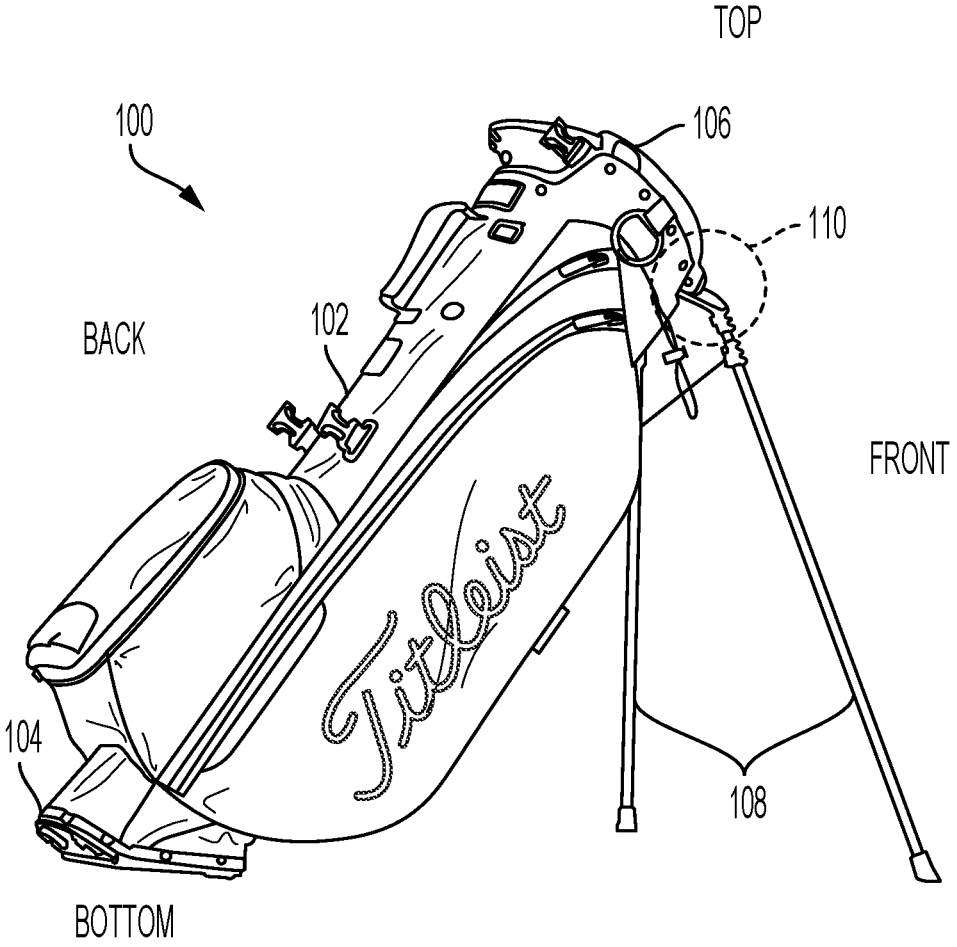
FIG. 1 depicts an example golf bag with expandable legs.

FIG. 1 depicts an example golf bag 100 with expandable legs 108. The golf bag 100 includes a bag body 102, which may include a plurality of pockets, handles, and clips for shoulder straps, among other features. A top cuff 106 is located at the top of the golf bag 100. The top cuff 106 may be a substantially rigid component that may be molded. The top cuff 106 forms the upper perimeter of the golf bag 100. A leg-deployment system 110 is included on or as part of the top cuff 106, as discussed further below. The foot or base 104 of the golf bag 100 is located at the bottom of the bag body 102. When the golf bag 100 is placed on the ground, the base 104 may hinge and activate an activation mechanism that causes the legs 108 to deploy in their expanded state, as shown in FIG. 1.

The portion of the golf bag 100 from which the legs 108 protrude may be considered a front side of the golf bag 100, whereas the opposite side may be considered the back side of the golf bag 100. The end of the golf bag 100 with the top cuff 106 may be considered top of the golf bag 100, and the end of the golf bag 100 with the base 104 may be considered the bottom of the golf bag 100.

Figure 2:
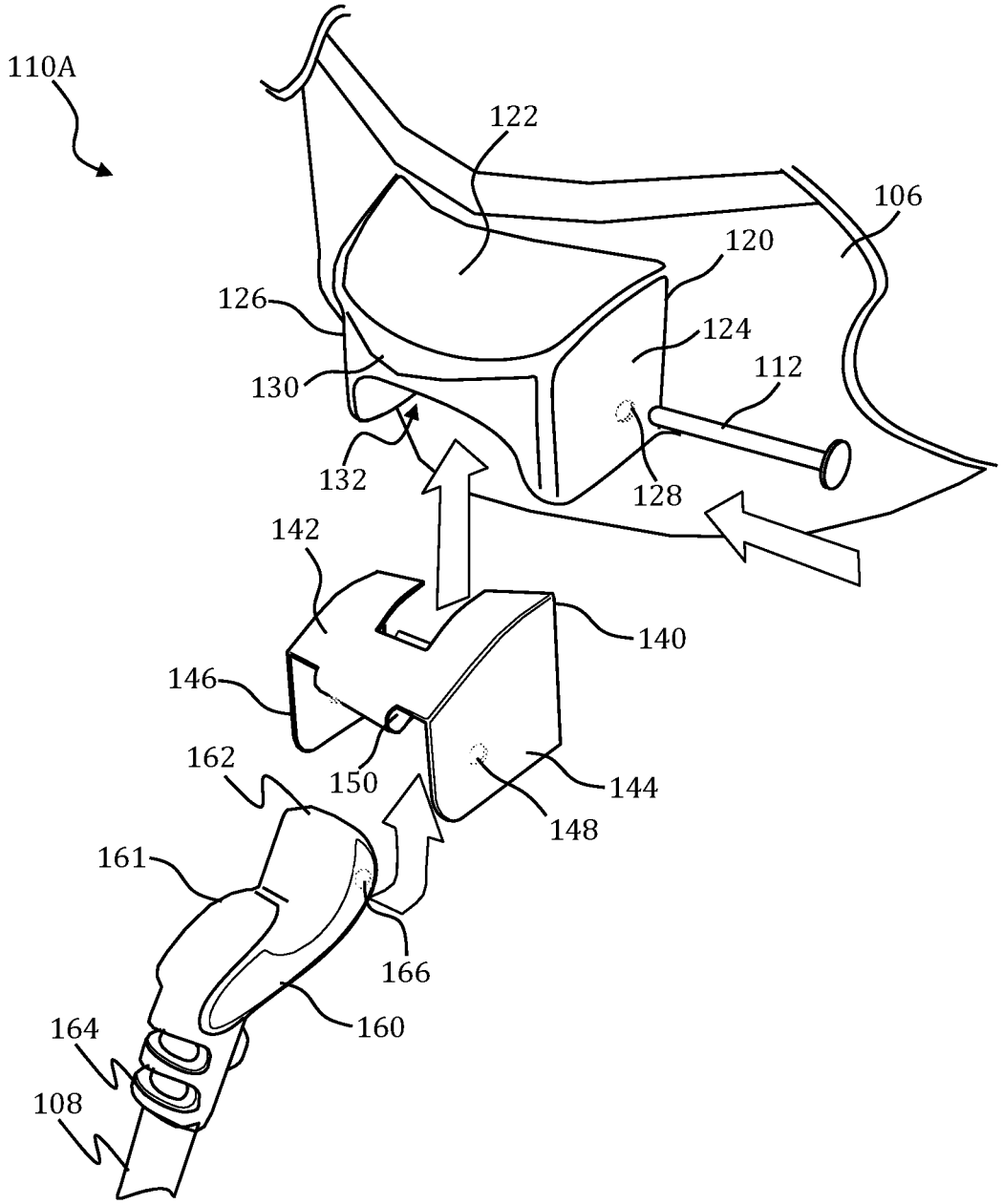
FIG. 2 depicts an exploded view of an example leg-deployment system.

FIG. 2 depicts an exploded view of an example leg-deployment system 110A. The leg deployment system includes a leg receptacle 120, a spring insert 140, and a leg assembly 160.

The leg receptacle protrudes from an exterior wall of the top cuff 106 of the golf bag 100. The leg receptacle 120 includes an outer side wall 124 that faces away from a center of the top cuff 106 and an inner side wall 126 that faces towards the center of the top cuff 106 (e.g., faces a point in between the legs 108). The leg receptacle 120 also includes a top wall 122 and a front wall 130. The front wall 130 may be a partial wall with an opening to allow for deployment of the leg assembly 160. The leg receptacle 120 includes a cavity 132 that is defined by the outer side wall 124, the inner side wall 126, the top wall 122, and the front wall 130. The leg receptacle 120 may be formed from a molding process such that the leg receptacle 120 is formed as a single piece or component, which may be made from a plastic or similar material.

The outer side wall 124 and the inner side wall 126 each include a through hole 128 that receives a pin or rivet 112. The pin or rivet 112 has a shaft and a head such that the head is larger in circumference than the through hole 128 to prevent the head from going through the through hole 128.

The spring insert 140 is sized and configured to be inserted into the cavity 132 of the leg receptacle 120. The spring insert 140 includes a top wall 142, an outer side wall 144 that faces away from a center of the top cuff 106, and an inner side wall 146 that face towards the center of the top cuff 106. The outer side wall 144 and the inner side wall 146 each include a through hole 148 that is sized and configured to receive the rivet 112.

When the spring insert 140 is inserted into the cavity 132, the outer surfaces of the outer side wall 144 and the inner side wall 146 may contact the inner surfaces of the outer side wall 124 and the inner side wall 126, respectively. In addition, the holes 148 and the holes 128 align such that the rivet 112 may pass through both set of holes. The outer or upper surface of the top wall 142 may also contact the inner or lower surface of the top wall 122.

The spring insert 140 also includes a cantilevered elongated spring segment 150 that extends from the top wall 142 and back, towards the exterior surface of the top cuff 106, under the top wall 142. The details and function of the spring segment 150 are discussed further below.

The leg assembly 160 includes a knuckle 161 that has an opening 164 for receiving a leg 108. An upper portion of the knuckle 161 includes a through hole 166 and a protruding portion 162 that protrudes upward and forward from the through hole 166 when the bag 100 is in the retracted state and the bag is placed in a vertical position with the base on the ground. The protruding portion 162 may also be referred to as a cam nose 162. When the leg assembly 160 is placed in the spring insert 140, the through hole 166 aligns with the holes 148 and the holes 128 such that the rivet 112 is able to pass through all of the holes and secure the leg assembly 160 and the spring insert 140 in the leg receptacle 120. The leg assembly 160 may then rotate around the shaft of the rivet 112. As the leg assembly 160 rotates around the shaft, the cam nose 162 contacts different portions of the spring segment 150, which applies pressure to the cam nose 162, as discussed further below.

Figure 3:
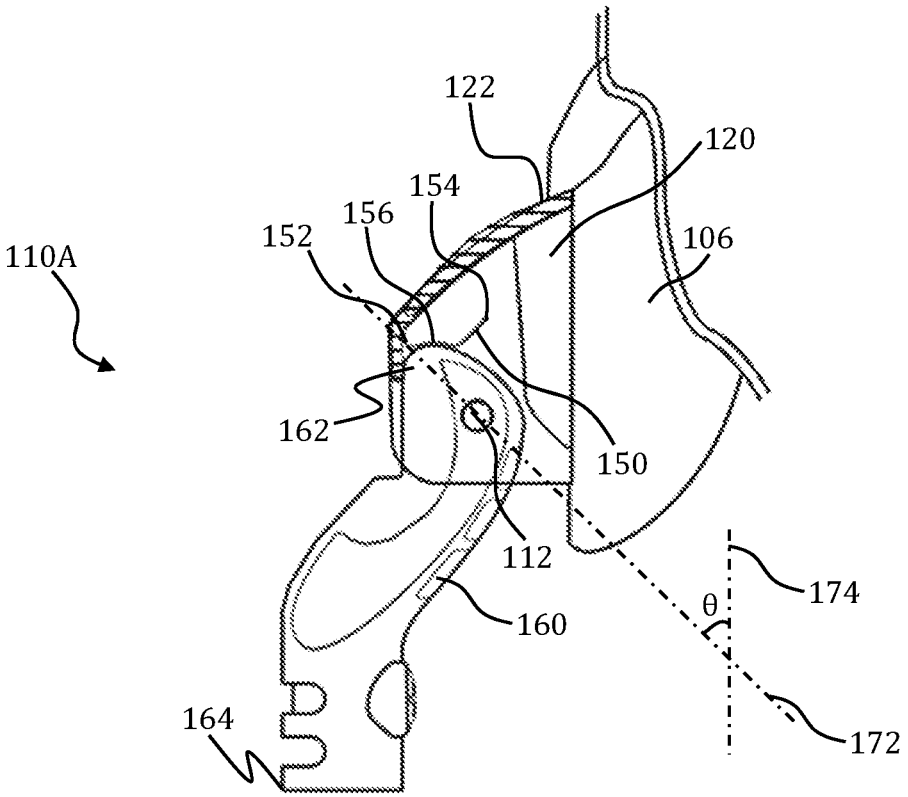
FIG. 3 depicts the example leg-deployment system of FIG. 2 in a retracted state.

FIG. 3 depicts the example leg-deployment system 110A of FIG. 2 in a retracted state. FIG. 3 shows a cross section of the example leg-deployment system 110A in its assembled configuration with the spring insert 140 inserted into the cavity 132 of the leg receptacle 120 and the leg assembly 160 inserted into the spring insert 140 with the rivet 112 inserted through the respective through holes. When in the retracted state, the spring segment 150 applies pressure to the cam nose 162 to help hold the leg assembly 160 in place to prevent leg droop.

As briefly discussed above the spring segment 150 is a cantilevered or flat spring that extends from the top wall 142 of the spring insert 140 and curls back towards the top cuff 106. The portion of the spring segment 150 that is located underneath the top wall 142 includes a fixed end 152, a free end 154, and a recessed portion 156 between the fixed end 152 and the free end 154. The fixed end 152 is near the front of the spring insert 140. For instance, the fixed end 152 may be the end of the spring segment 150 that is furthest from the exterior surface of the top cuff 106. The fixed end 152 is fixed to the top wall 142 of the spring insert 140 and may be formed from the material of the top wall 142 curling underneath the top wall 142 to form the spring segment 150. The free end 154 is the end of the spring segment 150 opposite the fixed end 152. For instance, the free end 154 is the end of the spring segment 150 that is closest to the exterior surface of the top cuff 106. The recessed portion 156 may be a bend in the spring segment 150 that provides a recess or well for the cam nose 162 when the cam nose 162 is in the retracted state.

A portion of the spring segment 150 between the recessed portion 156 and the and free end 154 may be ramped in an upward direction (e.g., towards the top of the top cuff 106). Such a portion may be referred to as the ramped portion of the spring segment 150. By including such a ramped portion, the cam nose 162 is able to more easily slide against the lower surface of the spring segment 150 when the leg-deployment system 110A is in either the retracted or expanded state. The ramped portion also prevents the free end 154 from the digging into the surface of the cam nose 162, which could potentially cause the leg-deployment system 110A to become stuck in the expanded state and/or cause damage to the surface of the cam nose 162. For instance, the spring segment 150 may be configured such that the fixed end 152 does not directly contact the cam nose 162 in either the retracted or expanded state.

As shown in FIG. 3, when the leg-deployment system 110A is in the retracted state, the cam nose 162 is positioned or rests in the recessed portion 156 of the spring segment 150. The spring segment 150 is bent or pre-loaded such that the spring segment 150 applied an at least partially downward force on the cam nose 162 when the cam nose 162 is in the retracted state. The force helps maintain the position of the leg assembly 160, which prevents leg droop. The amount of the force may be adjusted by adjusting the bend and pre-loading the of cantilevered spring segment 150 along with the material with which the spring segment 150 and the spring insert 140 are made. The spring insert 140 (including the spring segment 150) may be made from a metallic material. The spring insert 140 is configured to provide spring forces adequate to hold the cam nose 162 in place while the bag is being carried but also to allow the leg assembly 160 to deploy and rotate around the rivet 112 when the bag is placed on the ground or the legs 108 are otherwise actuated (e.g., from a hand-based actuator handle rather than a foot-based actuator).

As discussed above, the cam nose 162 is a protrusion that extends upward and forward from the through hole 166 when the bag 100 is in the retracted state and the bag 100 is placed in a vertical position with the base on the ground. The cam nose 162 may be characterized by a cam nose angle (0) that is defined as the acute angle between a cam lobe axis 172 and a vertical axis 174 when the bag 100 is placed in a vertical position. The cam lobe axis 172 extends through the center of the hole 166 and a point of the cam nose 162 that is located furthest from the hole 166. In some examples, the cam nose angle (0) may be between 30-70 degrees.

Figure 4:
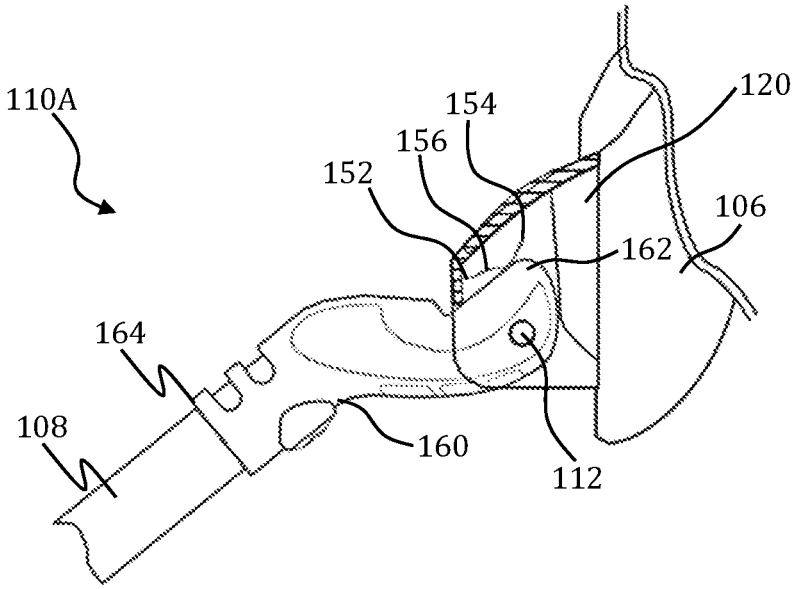
FIG. 4 depicts the example leg-deployment system of FIG. 2 in the expanded state.

FIG. 4 depicts the example leg-deployment system 110A of FIG. 2 in the expanded state. When the legs 108 are deployed into the expanded state, such as when transitioning from the retracted state to the expanded state, the leg assembly 160 rotates around the rivet 112 and the legs 108 deploy outward from the bag body. The shaft of the pin or rivet 112 defines a shaft axis that may be an axis about which the leg assembly 160 rotates.

When the legs 108 are deployed, the cam nose 162 rotates around the shaft axis of the rivet 112. More specifically, the cam nose 162 rotates towards the bag body or towards the exterior surface of the top cuff 106. The cam nose 162 rotates out from the recessed portion 156 of the spring segment 150 and into a position under the ramped portion of the spring segment 150. For instance, the cam nose 162 rotates to a position that is between the recessed portion 156 and the exterior surface of the top cuff 106. When in the expanded state, the spring segment 150 may also apply a force to help keep the legs 108 in that expanded state. The force, however, is overcome when the golf bag 100 is lifted (and/or a hand actuator is released/deactivated) to allow the leg-deployment system 110A to return to the retracted state. For instance, when the leg-deployment system 110A moves to the retracted state, the cam nose 162 rotates forward around the rivet 112 (e.g., rotates away from the exterior surface of the top cuff 106).

Figure 5:
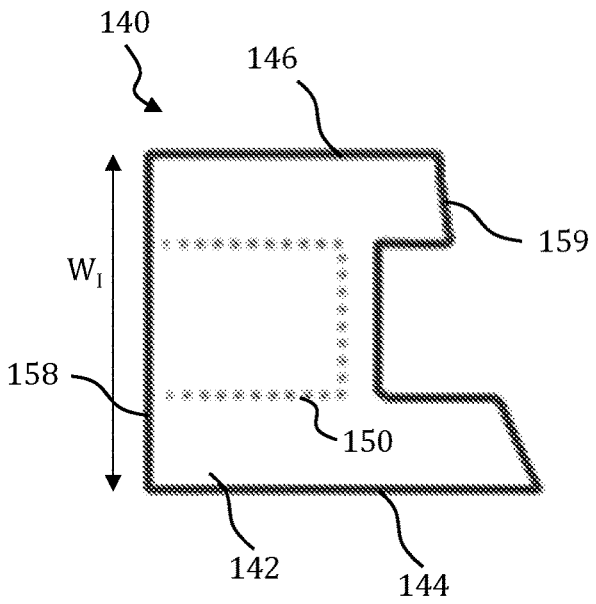
FIG. 5 depicts a top view of an example spring insert of the example leg-deployment system of FIG. 2.
Figure 6:
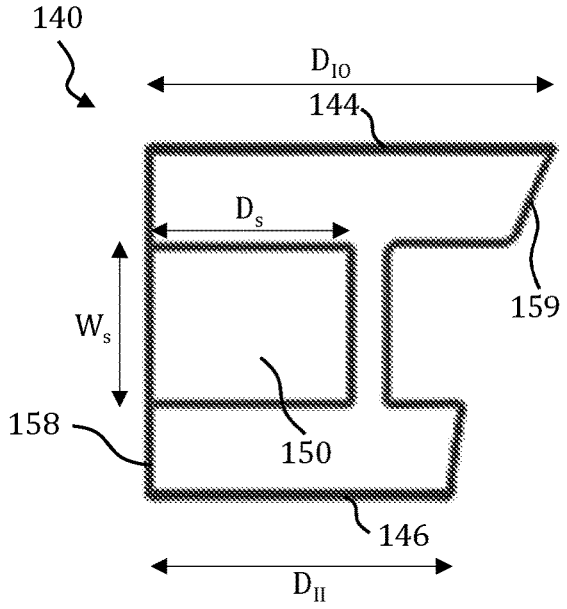
FIG. 6 depicts a bottom view of the example spring insert of FIG. 5.

FIG. 5 depicts a top view of an example spring insert 140 of the example leg-deployment system of FIG. 2. FIG. 6 depicts a bottom view of the example spring insert 140 of FIG. 5. The spring insert 140 has a width ($W_1$) that is measured generally from a left to right direction when incorporated into the leg-deployment system 110A of the golf bag 100. The width ($W_1$) may be a width of a front edge 158 of the spring insert 140 the extends between the outer side wall 144 and the inner side wall 146.

The spring insert 140 also has depths ($D_{10}$ and $D_{11}$) that are measured in a direction away from and substantially orthogonal from the exterior surface of the top cuff 106. For instance, the depths represent an amount of protrusion outward from the exterior surface of the top cuff 106. The example spring insert 140 depicted in FIGS. 5-6 is asymmetric. That is, the outer side wall 144 and the inner side wall 146 have different depths. For example, the outer side wall 144 depth ($D_{10}$) of the spring insert 140 is greater/longer than the inner side wall 146 depth ($D_{11}$). Such depths may also be referred to as a minimum depth and a maximum depth. The difference in depths may allow for the spring insert 140 to better match the contour of the exterior surface of the top cuff 106 and/or to provide for a proper or desired deployment angle for the corresponding leg 108. A back edge 159 may also be angled to follow or match the contour of the exterior surface of the top cuff or an interior surface of the leg receptacle 120 that defines the cavity 132. A portion of the top wall 142 near the back edge 159 and between the outer side wall 144 and the inner side wall 146 may also be omitted or removed. Because the spring insert 140 is asymmetric, different spring inserts 140 are used for the left leg and the right leg.

The spring segment 150 also has a width ($W_s$) and a depth ($D_s$). The width ($W_s$) of the spring insert 140 may be at least 25%, 40%, or 50% of the width ($W_1$) of the spring insert 140. Having a wider spring segment 150 may result in stronger spring forces applied to the cam nose 162. The depth ($D_s$) of the spring segment 150 may be at least 50% of the minimum depth of the spring insert 140. In some examples, the depth ($D_s$) of the spring segment 150 may be at least 30% or 40% of the maximum depth of the spring insert 140. Having a longer spring segment 150 may provide a better surface for which the cam nose 162 may slide and may also help prevent the free end 154 of the spring segment 150 from digging into or contacting the cam nose 162.

Figure 7:
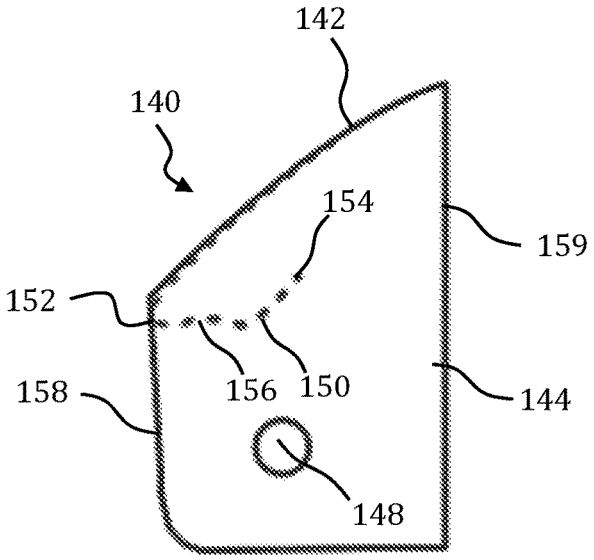
FIG. 7 depicts a side view of the example spring insert of FIG. 5.

FIG. 7 depicts a side view of the example spring insert 140 of FIGS. 5-6. As can be seen from the side view, the top wall 142 slopes downward from the back edge 159 to the front edge 158. The fixed end 152, free end 154, and the recessed portion 156 may also be more clearly seen from the side view. The recessed portion 156 includes a recess or bend in the direction of the top wall 142. The recessed portion 156 is thus able to at least partially cradle the cam nose 162 when the leg-deployment system 110A is in the retracted state.

Figure 8:
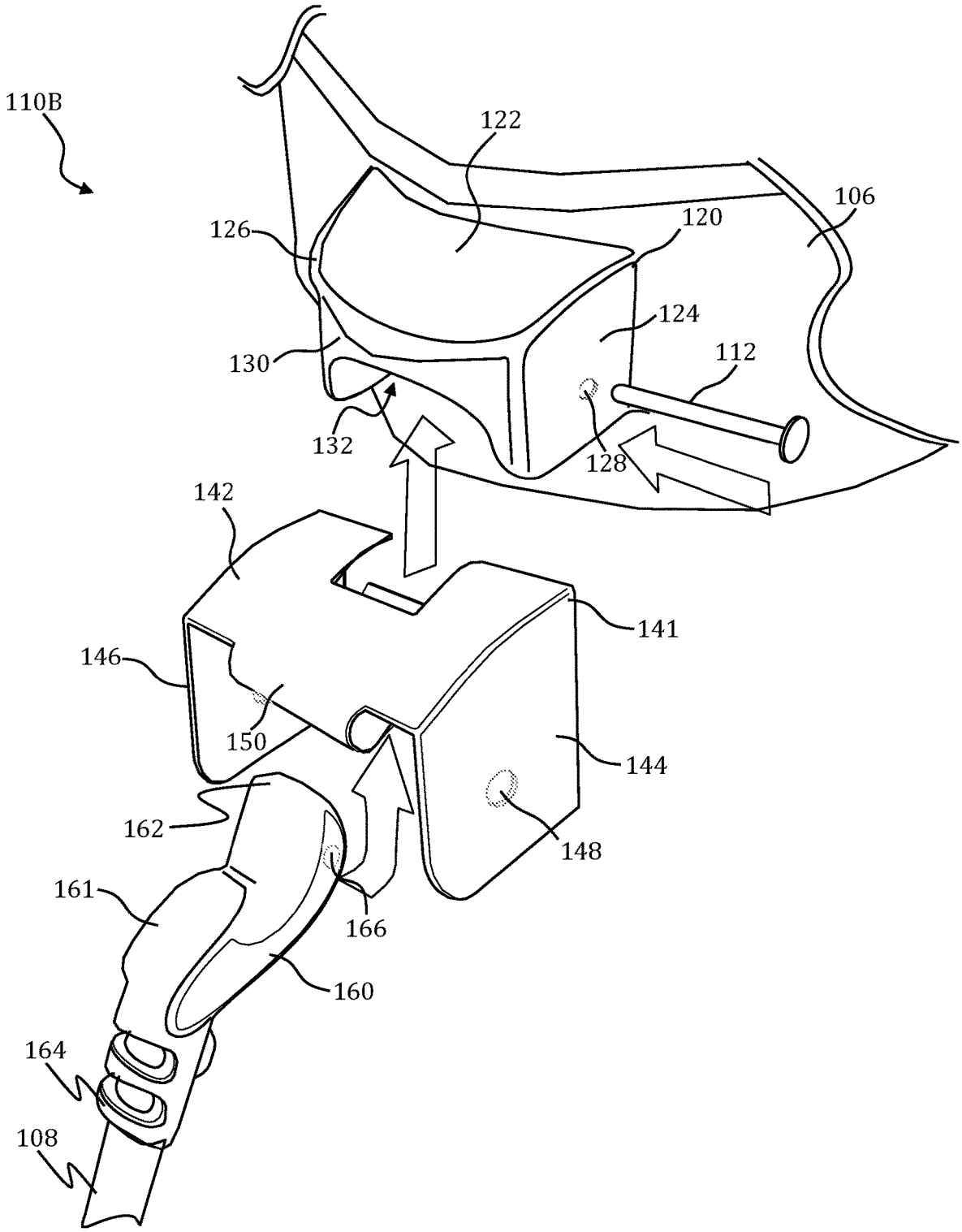
FIG. 8 depicts an exploded view of another example leg-deployment system.

FIG. 8 depicts an exploded view of another example leg-deployment system 110B. The example leg-deployment system 110B in FIG. 8 is substantially similar to the leg-deployment system 110A depicted in FIG. 2 with the exception that the example in FIG. 8 includes a symmetric spring insert 141 rather than the asymmetric spring insert 140 depicted in FIG. 2.

For example, the leg-deployment system 110 in FIG. 8 also includes a leg receptacle 120 and a leg assembly 160. The leg receptacle 120 is similarly coupled to the exterior surface of the top cuff 106. The leg receptacle 120 includes a top wall 122, an outer side wall 124, an inner side wall 126, and a front wall 130 that define a cavity 132 for receiving the symmetric spring insert 141.

The size and configuration of the leg receptacle 120 may be the same as the size and configuration of the leg receptacle 120 in FIG. 2. The asymmetric spring insert 140 in FIG. 2 may substantially match the shape of the cavity 132 of the leg receptacle 120. As such, the asymmetric spring insert 140 may provide a more secure fit inside the leg receptacle 120. The symmetric spring insert 141 of FIG. 8, however, may provide a slightly less secured fit inside the leg receptacle 120 because the back edge of the symmetric spring insert 141 does not match the shape of the cavity 132. The use of the rivet 112 to secure the symmetric spring insert 141 inside the leg receptacle 120 provides enough stability for use in the golf bag 100 and still provides enough force to help retain the leg assembly 160 in the retracted state to prevent leg droop.

While the symmetric spring insert 141 may provide somewhat less stability than the asymmetric spring insert 140, the symmetric spring insert 141 provides benefits in manufacturing and assembly of the leg-deployment system 110. For instance, unlike the asymmetric spring insert 140 which requires a different left and right spring insert 140, the symmetric spring insert 141 may be used for both the right and the left leg-deployment system 110.

Figure 9:
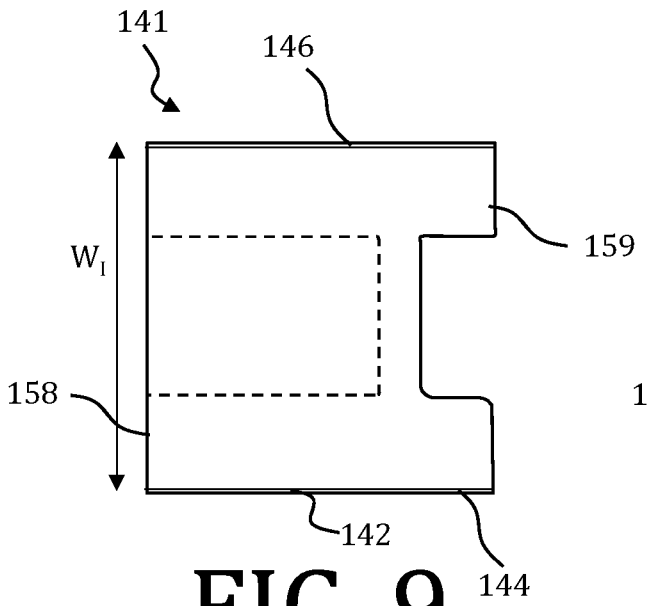
FIG. 9 depicts a top view of the example spring insert of the example leg-deployment system of FIG. 8.
Figure 10:
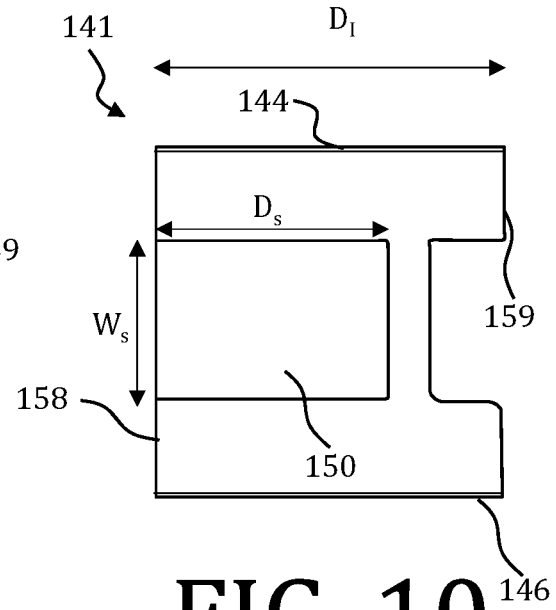
FIG. 10 depicts a bottom view of the example spring insert of FIG. 9.

FIG. 9 depicts a top view of the example symmetric spring insert 141 of the example leg-deployment system of FIG. 8. FIG. 10 depicts a bottom view of the example symmetric spring insert of FIG. 9. The spring insert 141 has a width ($W_1$) that may be measured in the same manner as discussed above. The spring insert 141 also has a depth ($D_1$) that may be measured in the same manner as discussed above. Unlike the asymmetric spring insert 141, the symmetric spring insert 141 may have a substantially consistent depth ($D_1$). For instance, the outer side wall 144 and the inner side wall 146 may have substantially the same depth. The spring segment 150 also has a width ($W_S$) and a depth ($D_S$). In some examples, the spring segment 150 has a depth ($D_S$) that is greater than the width ($W_S$). The depth ($D_S$) of the spring segment 150 may be at least 50% depth ($D_1$) of the symmetric spring insert 141.

Figure 11:
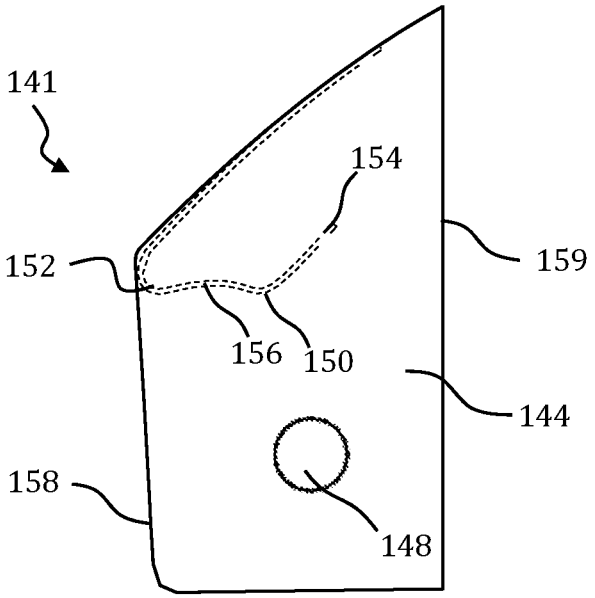
FIG. 11 depicts a side view of the example spring insert of FIG. 9.

FIG. 11 depicts a side view of the example symmetric spring insert 140 of FIG. 9. The side view of the symmetric spring insert 141 may be substantially similar to the asymmetric spring insert 140. For instance, the symmetric spring insert 141 includes a spring segment 150 that has a fixed end 152, a free end 154, and a recessed portion 156 between the fixed end 152 and the free end 154. A ramped portion may also be between the recessed portion 156 and the free end 154. The spring segment 150 of the symmetric spring insert 141 may function in substantially the same manner as the spring segment of the asymmetric spring insert 140.

Figure 12:
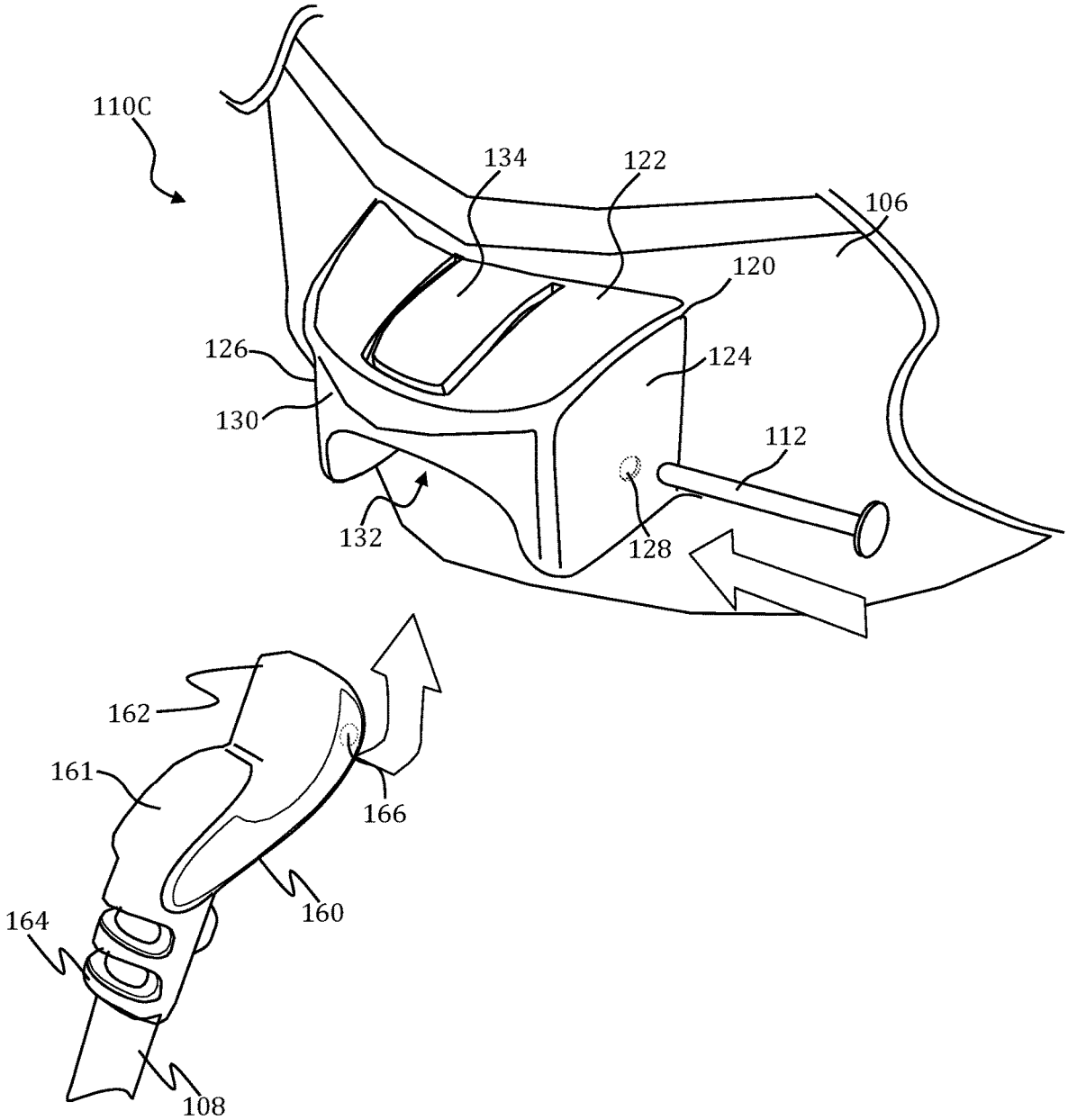
FIG. 12 depicts an exploded view of another example leg-deployment system.

FIG. 12 depicts an exploded view of another example leg-deployment system 110C. In the leg-deployment system 110C, a spring insert 140 is omitted from the system. Instead, the spring functionality used to retain the leg assembly 160 in the retracted state is integrated into the leg receptacle 120.

In the leg-deployment system 110C, the leg receptacle 120 includes a top wall 122, an outer side wall 124, an inner side wall 126, and a front wall 130. The top wall 122, outer side wall 124, inner side wall 126, and the front wall 130 form a cavity 132. The top wall 122 includes an elongated cantilevered spring segment 134 that is partially separated from the remainder of the top wall 122. For instance, the cantilevered spring segment 134 has a fixed end that is located near the exterior surface of the top cuff 106. The remainder of the cantilevered spring segment 134 is separated from the top wall 122.

The leg assembly 160 may be the same as the leg assemblies discussed above. For instance, the knuckle 161 includes a through hole 166. When the leg assembly 160 is inserted into the cavity 132 of the leg receptacle 120, the hole 166 aligns with the through holes 128 of the leg receptacle 120. Thus, the shaft of the pin or rivet 112 may extend through the holes 166 and the holes 128. As a result, the leg assembly 160 may rotate around the shaft of the rivet 112.

Figure 13:
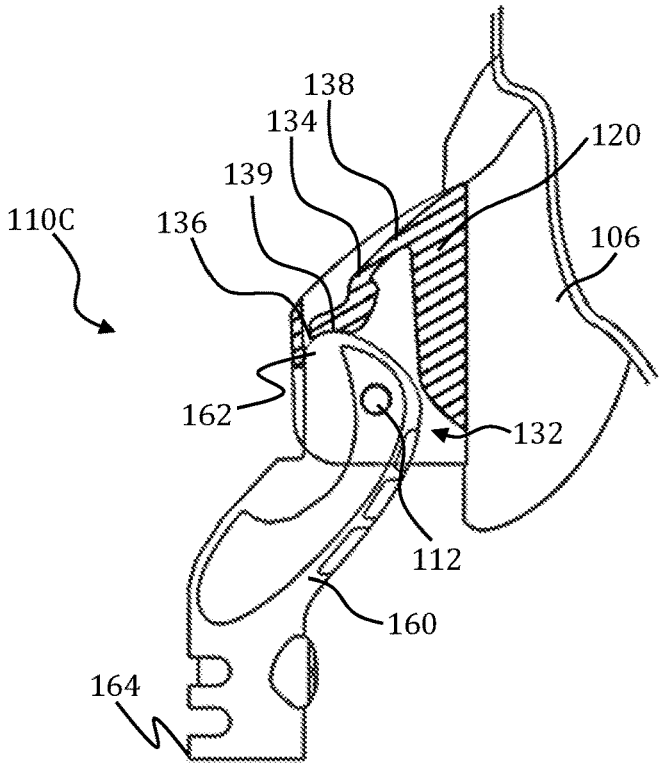
FIG. 13 depicts the example leg-deployment system of FIG. 12 in a retracted state.

FIG. 13 depicts the example leg-deployment system 110C of FIG. 12 in a retracted state. FIG. 13 shows a cross section of the example leg-deployment system 110C in its assembled configuration with the leg assembly 160 inserted into the cavity 132 of the leg receptacle 120 with the rivet 112 inserted through the respective through holes.

Additional details of the cantilevered spring segment 134 of the leg receptacle 120 can be seen in FIG. 13. For instance, the cantilevered spring segment 134 extends downwardly and away from the exterior surface of the top cuff 106. For instance, the cantilevered spring segment 134 protrudes into the cavity 132. The cantilevered spring segment 134 includes a fixed end 138, a free end 136, and a recessed portion 139 located between the fixed end 138 and the free end 136. The fixed end 138 is closer to the top cuff 106 than the free end 136. The recessed portion 139 may also be located closer to the free end 136 than the fixed end 138.

When the leg-deployment system 110C is in the retracted state, the cam nose 162 contacts the recessed portion 139. The cantilevered spring segment 134 applies a force against the cam nose 162 to maintain the leg assembly 160 in the retracted state and help prevent leg droop. Accordingly, to apply the force, the cantilevered spring segment 134 may be pre-loaded such that when the cam nose 162 is in contact with the recessed portion 139, the cantilevered spring segment 134 applies a pressure against the cam nose 162.

Figure 14:
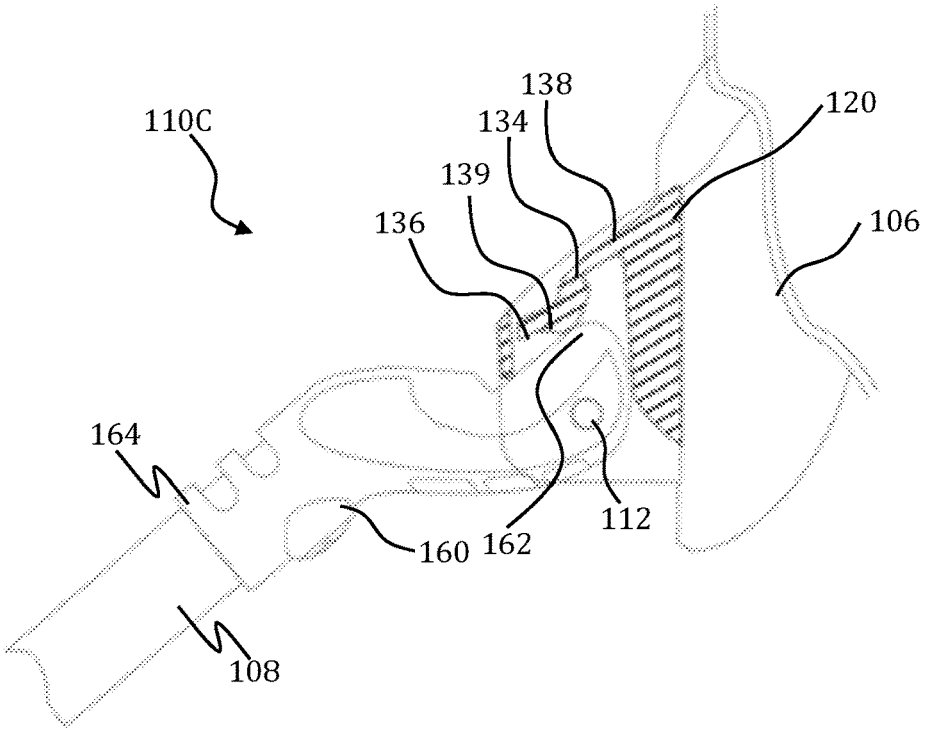
FIG. 14 depicts the example leg-deployment system of FIG. 12 in the expanded state.

FIG. 14 depicts the example leg-deployment system 110C of FIG. 12 in the expanded state. When the legs 108 are deployed and the leg-deployment system 110C moves to the expanded state, the leg assembly 160 rotates around the shaft of the pin 112. More specifically, the cam nose 162 rotates towards the exterior surface from the top cuff 106. As the cam nose 162 rotates, the cam nose 162 moves out from the recessed portion 139. For instance, in the expanded state, the cam nose 162 moves to a position between the recessed portion 139 and the exterior surface of the top cuff 106.

The embodiments described herein may be employed using software, hardware, or a combination of software and hardware to implement and perform the systems and methods disclosed herein. Although specific devices have been recited throughout the disclosure as performing specific functions, one of skill in the art will appreciate that these devices are provided for illustrative purposes, and other devices may be employed to perform the functionality disclosed herein without departing from the scope of the disclosure. In addition, some aspects of the present disclosure are described above with reference to block diagrams and/or operational illustrations of systems and methods according to aspects of this disclosure. The functions, operations, and/or acts noted in the blocks may occur out of the order that is shown in any respective flowchart. For example, two blocks shown in succession may in fact be executed or performed substantially concurrently or in reverse order, depending on the functionality and implementation involved.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A golf bag comprising:
- a bag body;
- a base coupled to the bag body;
- a top cuff coupled to the bag body; and
- a leg-deployment system coupled to the top cuff, the leg-deployment system comprising:
  - a leg receptacle protruding away from an exterior surface of the top cuff;
  - a spring insert inserted into the receptacle, the spring insert including a cantilevered spring segment having a fixed end and a free end; and
  - a leg assembly including a cam nose, wherein the cam nose contacts the cantilevered spring segment when the leg assembly is in a retracted state, and the cantilevered spring segment applies a force to the cam nose to maintain the leg assembly in the retracted state.

2. The golf bag of claim 1, wherein the cantilevered spring segment includes a recessed portion between the fixed end and the free end, and the cam nose is positioned in contact with the recessed portion when the leg assembly is in the retracted state.

3. The golf bag of claim 2, wherein the cam nose is not in contact with the recessed portion when the leg assembly is in an expanded state.

4. The golf bag of claim 1, wherein the leg-deployment system further includes a pin having a shaft that extends through the leg receptacle, the spring insert, and the leg assembly, wherein the leg assembly is configured to rotate around the shaft.

5. The golf bag of claim 4, wherein rotation of the leg assembly around the shaft during a transition from the retracted state to an expanded state causes the cam nose to rotate towards the exterior surface of the top cuff.

6. The golf bag of claim 4, wherein, when in the retracted state, the cam nose protrudes upward and away from the exterior surface of the top cuff relative to the shaft.

7. The golf bag of claim 1, wherein the spring insert is made of a metallic material and the leg receptacle is made of a molded plastic material.

8. The golf bag of claim 1, wherein the leg receptacle includes an outer side wall that has a first depth and inner side wall that has a second depth that is different from the first depth.

9. The golf bag of claim 1, wherein the leg receptacle includes an outer side wall that has a first depth and inner side wall that has a second depth that is substantially the same as the first depth.

10. A golf bag comprising:
- a bag body;
- a base coupled to the bag body;
- a top cuff coupled to the bag body; and
- a leg-deployment system coupled to the top cuff, the leg-deployment system comprising:
  - a receptacle protruding away from an exterior surface of the top cuff, the receptacle including a top wall, an outer side wall, and an inner side wall that at least partially define a cavity;
  - a spring insert inserted into the cavity, the spring insert including a cantilevered spring segment having a fixed end, a free end, and a recessed portion positioned between the fixed end and the free end; and a leg assembly including a cam nose, wherein the cam nose contacts the recessed portion when the leg assembly is in a retracted state, and the cantilevered spring segment applies a force to the cam nose to maintain the leg assembly in the retracted state.

11. The golf bag of claim 10, wherein the cam nose is not in contact with the recessed portion when the leg assembly is in an expanded state.

12. The golf bag of claim 10, wherein the leg-deployment system further includes a pin having a shaft that extends through the receptacle, the spring insert, and the leg assembly, wherein the leg assembly is configured to rotate around the shaft.

13. The golf bag of claim 12, wherein rotation of the leg assembly around the shaft moving from the retracted state to an expanded state causes the cam nose to rotate towards the exterior surface of the top cuff.

14. The golf bag of claim 12, wherein, when in the retracted state, the cam nose protrudes upward and away from the exterior surface of the top cuff relative to the shaft.

15. The golf bag of claim 10, wherein the receptacle includes an outer side wall that has a first depth and inner side wall that has a second depth that is different from the first depth.

16. A golf bag comprising:

a bag body;

a base coupled to the bag body;

a top cuff coupled to the bag body;

a leg receptacle protruding away from an exterior surface of the top cuff, the leg receptacle including a top wall, an outer side wall, and an inner side wall that at least partially define a cavity, wherein the top wall defines a cantilevered spring segment that protrudes at least partially into the cavity; and a leg assembly including a cam nose inserted into the cavity, wherein the cam nose contacts the cantilevered spring segment when the leg assembly is in a retracted state, and the cantilevered spring segment applies a force to the cam nose to maintain the leg assembly in the retracted state.

17. The golf bag of claim 16, wherein the cantilevered spring segment includes a fixed end, a free end, and a recessed portion between the fixed end and the free end.

18. The golf bag of claim 17, wherein, when the leg assembly is in the retracted state, the cam nose contacts the recessed portion.

19. The golf bag of claim 18, wherein the cam nose is not in contact with the recessed portion when the leg assembly is in an expanded state.

20. The golf bag of claim 16, wherein the cam nose has a cam nose angle ($\theta$) between 30-70 degrees.

* * * * *